US007515064B2

(12) United States Patent
Schwartz

(10) Patent No.: US 7,515,064 B2
(45) Date of Patent: Apr. 7, 2009

(54) REMOTE ACTIVATION OF A VEHICLE PRIORITY SYSTEM

(75) Inventor: Mark A. Schwartz, River Falls, WI (US)

(73) Assignee: Global Traffic Technologies, LLC, Oakdale, MN (US)

( * ) Notice: Subject to any disclaimer, the term of this patent is extended or adjusted under 35 U.S.C. 154(b) by 217 days.

(21) Appl. No.: 11/154,348

(22) Filed: Jun. 16, 2005

(65) Prior Publication Data

US 2007/0008174 A1 Jan. 11, 2007

(51) Int. Cl.
*G08G 1/00* (2006.01)

(52) U.S. Cl. ..... 340/902; 340/904; 340/924; 340/994; 340/995.17

(58) Field of Classification Search ..... 340/902, 340/904, 905, 916, 924, 994, 995.17
See application file for complete search history.

(56) References Cited

U.S. PATENT DOCUMENTS

| | | | |
|---|---|---|---|
| 3,550,078 | A | 12/1970 | Long |
| 3,831,039 | A | 8/1974 | Henschel |
| 4,162,447 | A | 7/1979 | Teshirogi et al. |
| 4,162,477 | A | 7/1979 | Munkberg |
| 4,228,419 | A | 10/1980 | Anderson |
| 4,230,992 | A | 10/1980 | Munkberg |
| 4,234,967 | A | 11/1980 | Henschel |
| 4,463,339 | A | 7/1984 | Frick et al. |
| 4,680,811 | A | 7/1987 | Harper et al. |
| 4,704,610 | A | 11/1987 | Smith et al. |
| 4,717,913 | A | 1/1988 | Elger |
| 4,727,600 | A | 2/1988 | Avakian |
| 4,734,881 | A | 3/1988 | Klein et al. |
| 4,914,434 | A | 4/1990 | Morgan et al. |
| 4,970,439 | A | 11/1990 | Stopa |
| 4,972,185 | A | 11/1990 | Stopa et al. |
| 4,992,790 | A | 2/1991 | Montgomery |

(Continued)

FOREIGN PATENT DOCUMENTS

| | | | |
|---|---|---|---|
| WO | WO-2006138393 | A2 | 12/2006 |

OTHER PUBLICATIONS

"Strobecom II, Optical Preemption and Priority Control System", http://www.tomar.com/strobecom/index.htm, 3, pages. Printed from Internet Feb. 8, 2005.

(Continued)

*Primary Examiner*—Daryl C Pope
(74) *Attorney, Agent, or Firm*—Schwegman, Lundberg & Woessner, P.A.

(57) ABSTRACT

A remotely-activated vehicle priority system includes a control center, a vehicle-priority communication device, at least one receiver, and a phase selector. The control center transmits an activation message. The vehicle-priority communication device is mounted to a vehicle and is communicatively coupled to the control center. In response to the activation message, the vehicle-priority communication device transmits a priority preemption request. Transmission of the priority preemption request in response to the activation message prevents improper activation, either intentional or unintentional, of the vehicle priority system by an operator of the vehicle. The receiver is situated at a traffic signal and receives the priority preemption request. The phase selector issues, responsive to the priority preemption request, a command to a controller of the traffic signal. The command selects a phase for the traffic signal.

16 Claims, 3 Drawing Sheets

U.S. PATENT DOCUMENTS

| | | | | |
|---|---|---|---|---|
| 5,014,052 | A | 5/1991 | Obeck | |
| 5,159,480 | A | 10/1992 | Gordon et al. | |
| 5,172,113 | A | 12/1992 | Hamer | |
| 5,187,373 | A | 2/1993 | Gregori | |
| 5,187,476 | A | 2/1993 | Hamer | |
| 5,202,683 | A | 4/1993 | Hamer et al. | |
| 5,519,389 | A | 5/1996 | DeGunther et al. | |
| 5,539,398 | A | 7/1996 | Hall et al. | |
| 5,602,739 | A | 2/1997 | Haagenstad et al. | |
| 5,926,113 | A | 7/1999 | Jones et al. | |
| 5,986,575 | A | 11/1999 | Jones et al. | |
| 6,064,319 | A * | 5/2000 | Matta | 340/917 |
| 6,243,026 | B1 | 6/2001 | Jones et al. | |
| 6,281,808 | B1 | 8/2001 | Glier et al. | |
| 6,326,903 | B1 * | 12/2001 | Gross et al. | 340/988 |
| 6,429,812 | B1 | 8/2002 | Hoffberg | |
| 6,621,420 | B1 | 9/2003 | Poursartip | |
| 6,940,422 | B1 * | 9/2005 | Bachelder et al. | 340/906 |
| 6,985,090 | B2 * | 1/2006 | Ebner et al. | 340/907 |
| 7,116,245 | B1 | 10/2006 | Bachelder | |
| 7,202,776 | B2 * | 4/2007 | Breed | 340/435 |
| 7,248,149 | B2 * | 7/2007 | Bachelder et al. | 340/425.5 |
| 7,432,826 | B2 | 10/2008 | Schwartz | |
| 2003/0016143 | A1 | 1/2003 | Ghazarian | |
| 2005/0104745 | A1 | 5/2005 | Bachelder et al. | |
| 2007/0008173 | A1 | 1/2007 | Schwartz | |

OTHER PUBLICATIONS

Tomar Electronics, "Strobecom II", System Manual (Rev 3), Jun. 2000, 25 pages. Jun. 2000.

Tomar Electronics, "Strobecom II. Optical Signal Processor Configuration Software (OSPsoft)," User's Manual, Version 2.0 for use with OSP Version 2.0, May 2000, 40 pages. May 2000.

"Elock™ Emitter Authenticator," http://www.tomar.com/products/elock/elock.htm, 11 pages. Printed from Internet Apr. 27, 2005.

"U.S. Appl. No. 11/154,347 Response filed to Non-Final Office Action received Aug. 21, 2007.", 9 pgs.

"Non-Final Office Action mailed Aug. 21, 2007 in U.S. Appl. No. 11/154,347", OARN,8 pgs.

"PCT Application No. PCT/US06/23148, International Search Report mailed May 2, 2007", 3 pgs.

"PCT Application No. PCT/US06/23148, Written Opinion mailed May 2, 2007", 4 pgs.

"PCT Application No. PCT/US06/23190 International Search Report mailed Oct. 12, 2007", 2 pgs.

"PCT Application No. PCT/US06/23190 Written Opinion mailed Oct. 12, 2007", 4 pgs.

U.S. Appl. No. 11/154,347, Notice of Allowance mailed May 23, 2008, 6 pgs.

* cited by examiner

REMOTE ACTIVATION OF A VEHICLE PRIORITY SYSTEM

FIELD OF THE INVENTION

The present invention is generally directed to systems and methods that allow traffic signal systems to be controlled from an authorized vehicle.

BACKGROUND OF THE INVENTION

Traffic signals have long been used to regulate the flow of traffic at intersections. Generally, traffic signals have relied on timers or vehicle sensors to determine when to change the phase of traffic signal lights, thereby signaling alternating directions of traffic to stop, and others to proceed.

Emergency vehicles, such as police cars, fire trucks and ambulances, are generally permitted to cross an intersection against a traffic signal. Emergency vehicles have typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

There are presently a number of known optical vehicle priority systems that have equipment installed at certain traffic signals and on emergency vehicles. An optical signal from an optical emitter mounted to an emergency vehicle can transmit light pulses encoding a priority preemption request. The equipment installed at a traffic signal can adjust the phase of the traffic signal to expedite passage through the traffic signal by the emergency vehicle.

In these known optical vehicle priority systems, the operators of the emergency vehicle manually activate the optical emitter. This approach can be disadvantageous for certain applications or environments. For example, an operator can forget to activate the optical emitter when rushing to respond to an emergency situation. In addition, an operator can abuse the optical vehicle priority system by activating the optical emitter while not responding to an emergency situation. Abuse of an optical vehicle priority system can needlessly disrupt the normal traffic flow through the affected intersections.

SUMMARY

The present invention is directed to overcoming the above-mentioned challenges and others that are related to the types of approaches and implementations discussed above and in other applications. The present invention is exemplified in a number of implementations and applications, some of which are summarized below.

In connection with one embodiment, the present invention is directed to implementations that allow a vehicle priority system for traffic signals to be remotely activated. One such implementation starts and/or terminates transmission of data from a vehicle to traffic signal control equipment located at an intersection.

In a more particular example embodiment, a remotely-activated vehicle priority system includes a control center, a vehicle-priority communication device, at least one receiver, and a phase selector. The control center transmits an activation message. The vehicle-priority communication device is mounted to a vehicle and is communicatively coupled to the control center. In response to the activation message, the vehicle-priority communication device transmits a priority preemption request. The receiver is situated at a traffic signal and receives the priority preemption request. The phase selector issues, responsive to the priority preemption request, a command to a controller of the traffic signal. The command selects a phase for the traffic signal.

In another more particular example embodiment, a method is provided for remotely activating a vehicle priority system. An activation message is transmitted from a remote control center. A vehicle-priority communication device mounted to a vehicle receives the activation message. In response to the activation message, the vehicle-priority communication device a priority preemption request. The priority preemption request is received at a receiver situated proximate to a traffic signal. In response to the priority preemption request, a phase is requested for the traffic signal.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the detailed description of various embodiments of the invention in connection with the accompanying drawings, in which.

Figure 1:
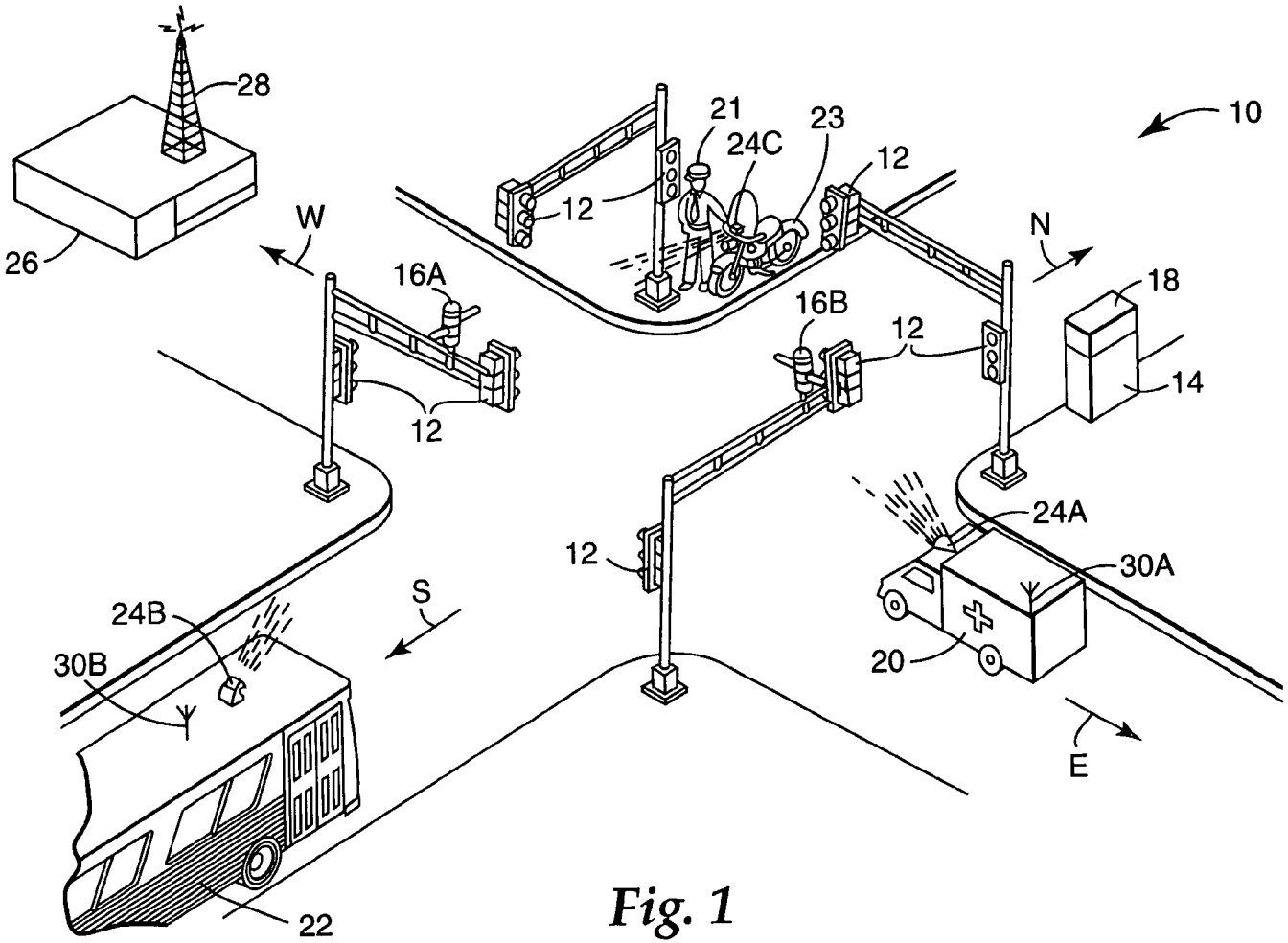
FIG. 1 is a perspective view of a mass transit vehicle and an ambulance approaching traffic signals at intersection, with communication devices mounted to the mass transit vehicle and the ambulance each transmitting apriority preemption request that is activated in accordance with the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION OF VARIOUS EMBODIMENTS

The present invention is believed to be applicable to a variety of different types of remote activation of a vehicle priority system. While the present invention is not necessarily limited to such approaches, various aspects of the invention may be appreciated through a discussion of various examples using these and other contexts.

One embodiment of the present invention is directed to a remotely-activated vehicle priority system that includes a CPU-based control center for transmitting an activation message as well as an intersection-vehicle communication arrangement. The intersection-vehicle communication arrangement includes a vehicle-priority communication device mounted to a vehicle and communicatively coupled to the control center. The vehicle-priority communication device is designed to transmit a priority preemption request (e.g., via optical or RF communications) in response to the activation message. The intersection-vehicle communication arrangement includes at least one (e.g., optical or RF) receiver situated at a traffic signal and a phase selector circuit. The receiver includes (e.g., optical or RF) circuitry that is compatibly designed relative to the vehicle-priority communication for receiving the priority preemption request. The phase selector is coupled to the at least one receiver and adapted to issue, responsive to reception of the priority preemption request, a command to a controller of the traffic signal. In response, the command selects a phase (e.g., for stopping cross traffic) for the traffic signal.

Such a vehicle priority system is shown in FIG. 1 so as to present basic circuitry useful for implementing example embodiments of the present invention. In this context, FIG. 1 illustrates a typical intersection 10 having traffic signals 12. A traffic signal controller 14 sequences the traffic signals 12 through a sequence of phases that allow traffic to proceed alternately through the intersection 10. Each authorized vehicle 20, 22, and 23 has a respective vehicle-priority communication device 24A, 24B, and 24C that transmits a priority preemption request to the phase selector 18 via receivers 16A and 16B at the intersection 10. The vehicle-priority communication devices 24A and 24B have certain aspects and features enabled in accordance with the present invention to provide activation of the transmission of the priority preemption request from a remote control center, such as dispatch center 26, in an efficient, flexible and practicable manner.

Dispatch center 26 has an antenna 28 communicatively coupled to antennas 30A and 30B on vehicles 20 and 22, respectively. A command or other data from the dispatch center 26 can activate a vehicle-priority communication device 24A on ambulance 20. In response to the activated vehicle-priority communication device 24A, the phase selector 18 can preempt the normal operation of the traffic signals 12 to give priority to ambulance 20 and allow expedited passage of the ambulance 20 through the intersection 10. Activation of vehicle-priority communication device 24A from the dispatch center 26 can thwart improper usage of the vehicle priority system, such as abuse of the vehicle priority system by an operator of an ambulance 20 that is not responding to an emergency situation. It will be appreciated that the vehicle-priority communication device 24B of mass transit vehicle 22 may similarly be activated by dispatch center 26. In addition, antenna 28 can be a number of distributed antennas, such as the antennas of a cellular telephone network or a wireless local area network.

An ambulance 20 and a mass transit vehicle 22 are approaching the intersection 10. The vehicle-priority communication device 24A is mounted on the ambulance 20 and the vehicle-priority communication device 24B is mounted on the mass transit vehicle 22. In one embodiment, the vehicle-priority communication devices 24A and 24B include optical emitters that each transmit a stream of light pulses. The stream of light pulses can transport codes that identify a requested operation, such as the priority preemption request. The receivers 16A and 16B can be detector assemblies stationed to receive these light pulses and send an output signal to the phase selector 18, which is often located in the same cabinet as the traffic controller 14. The phase selector 18 processes and validates the output signal from the receivers 16A and 16B. For validated output signals of a priority preemption request, the phase selector 18 issues a traffic preemption command to the traffic signal controller 14 to preempt the normal operation of the traffic signals 12.

A traffic preemption command requests a phase, which can be dependent on which one of multiple receivers 16A and 16B receives the light pulses for the priority preemption request. Ambulance 20 is approaching intersection 10 from the east and detector assembly receiver 16B is situated to receive light pulses from vehicles approaching intersection 10 from either the east or the west, while detector assembly receiver 16A is situated to receive light pulses from vehicles approaching intersection 10 from either the north or south. Thus, the light pulses emitted from vehicle-priority communication device 24A of ambulance 20 are received by detector assembly receiver 16B and are not received by detector assembly receiver 16A. Phase selector 18 receives an output signal of a priority preemption request from detector assembly receiver 16B, and the phase selector 18 issues a traffic preemption command to traffic controller 14 that selects a phase of traffic signals 12 presenting a green light to ambulance 20.

Similarly, mass transit vehicle 22 is approaching intersection 10 from the south and phase selector 18 receives an output signal for the light pulses of vehicle-priority communication device 24B via detector assembly receiver 16A. For light pulses representing a priority preemption request, phase selector 18 issues a traffic preemption command to traffic controller 14 that selects a phase of traffic signals 12 presenting a green light to mass transit vehicle 22.

It will be appreciated that an intersection can have less than four or more than for directions of approach to the intersection. In another embodiment, a radio frequency signal transmits the priority preemption request from a vehicle-priority communication device to one or multiple receivers 16A and 16B and the priority preemption request can include a direction of travel of the vehicle from which the phase selector 18 determines the appropriate phase for the traffic preemption command.

FIG. 1 also shows an authorized person 21 operating a portable vehicle-priority communication device 24C, which is there shown mounted to a motorcycle 23. The vehicle-priority communication device 24C can be used by the authorized person 21 to affect the traffic signals 12 in situations that require manual control of the intersection 10.

In one embodiment of the present invention, a vehicle priority system helps run a mass transit system more efficiently. An authorized mass transit vehicle 22 having a vehicle-priority communication device 24B constructed in accordance with the present invention, spends less time waiting at traffic signals, thereby saving fuel and allowing the mass transit vehicle 22 to serve a larger route. This also encourages people to utilize mass transportation instead of private automobiles because authorized mass transit vehicles move through congested urban areas faster than other vehicles.

Unlike an emergency vehicle, such as ambulance 20, a mass transit vehicle 22 equipped with a vehicle-priority communication device 24B may not require total preemption. In one embodiment, mass transit vehicle 22 has an operating schedule and a global positioning satellite (GPS) receiver in mass transit vehicle 22 provides coordinates of the current position of the mass transit vehicle 22 to the dispatch center 26. The dispatch center 26 compares the current position of the mass transit vehicle 22 with the expected position from the operating schedule. When the mass transit vehicle 22 is lagging behind the expected position by more than a specific amount of time and/or distance, the dispatch center 26 sends an activation message to vehicle-priority communication device 24B via antennas 28 and 30B. In response, the vehicle-priority communication device 24B starts transmitting a priority preemption request to intersections, such as intersection 10, approached by the mass transit vehicle 22. When the mass transit vehicle 22 is no longer behind schedule, the dispatch center 26 sends a deactivation message to vehicle-priority communication device 24B. In response, the vehicle-priority communication device 24B terminates transmission of the priority preemption request.

The priority preemption for a mass transit vehicle 22 may provide a traffic signal offset that gives preference to a mass transit vehicle 22, while still allowing all approaches to the intersection 10 to be serviced. For example, a traffic signal controller 14 that normally allows traffic to flow 50 percent of the time in each direction responds to repeated phase requests from the phase selector 18 by allowing traffic flowing in the direction of the mass transit vehicle 22 to proceed 65 percent of the time and traffic flowing in the other direction to flow 35 percent of the time. In this embodiment, the actual offset can be fixed to allow the mass transit vehicle 22 to have a predictable advantage.

The nominal frequency used to transmit pulses of an optical pulse stream used to transmit a priority preemption request can determine a priority level for the priority preemption request. For example, a frequency of approximately 10 Hz can correspond to a high priority for an emergency vehicle, such as ambulance 20, and a frequency of approximately 14 Hz can correspond to a low priority for a mass transit vehicle 22.

In certain installations, the vehicle priority system does not actually control the lights at a traffic intersection 10. Rather, the phase selector 18 alternately issues phase requests to and withdraws phase requests from the traffic signal controller 14, and the traffic signal controller 14 determines whether the phase requests can be granted. The traffic signal controller 14 may also receive phase requests originating from other sources, such as a nearby railroad crossing, in which case the traffic signal controller 14 can determine that the phase request from the other source should be granted before the phase request from the phase selector 18. However, as a practical matter, the vehicle priority system can affect a traffic intersection 10 and create a traffic signal offset by monitoring the traffic signal controller sequence and repeatedly issuing phase requests that will most likely be granted.

According to a specific example embodiment, the vehicle priority system of FIG. 1 is implemented using a known implementation that is modified to implement the codes and algorithms discussed above for remote activation. For example, an Opticom™ Priority Control System (manufactured by 3M Company of Saint Paul, Minn.) can be modified to implement the codes and algorithms discussed above for remote activation. Consistent with features of the Opticom™ Priority Control System, one or more embodiments of U.S. Pat. No. 5,172,113 can be modified in this manner. Also according to the present invention, another specific example embodiment is implemented using another so-modified commercially-available vehicle priority system, such as the Strobecom II system (manufactured by TOMAR Electronics, Inc. of Phoenix, Ariz.).

Figure 2:
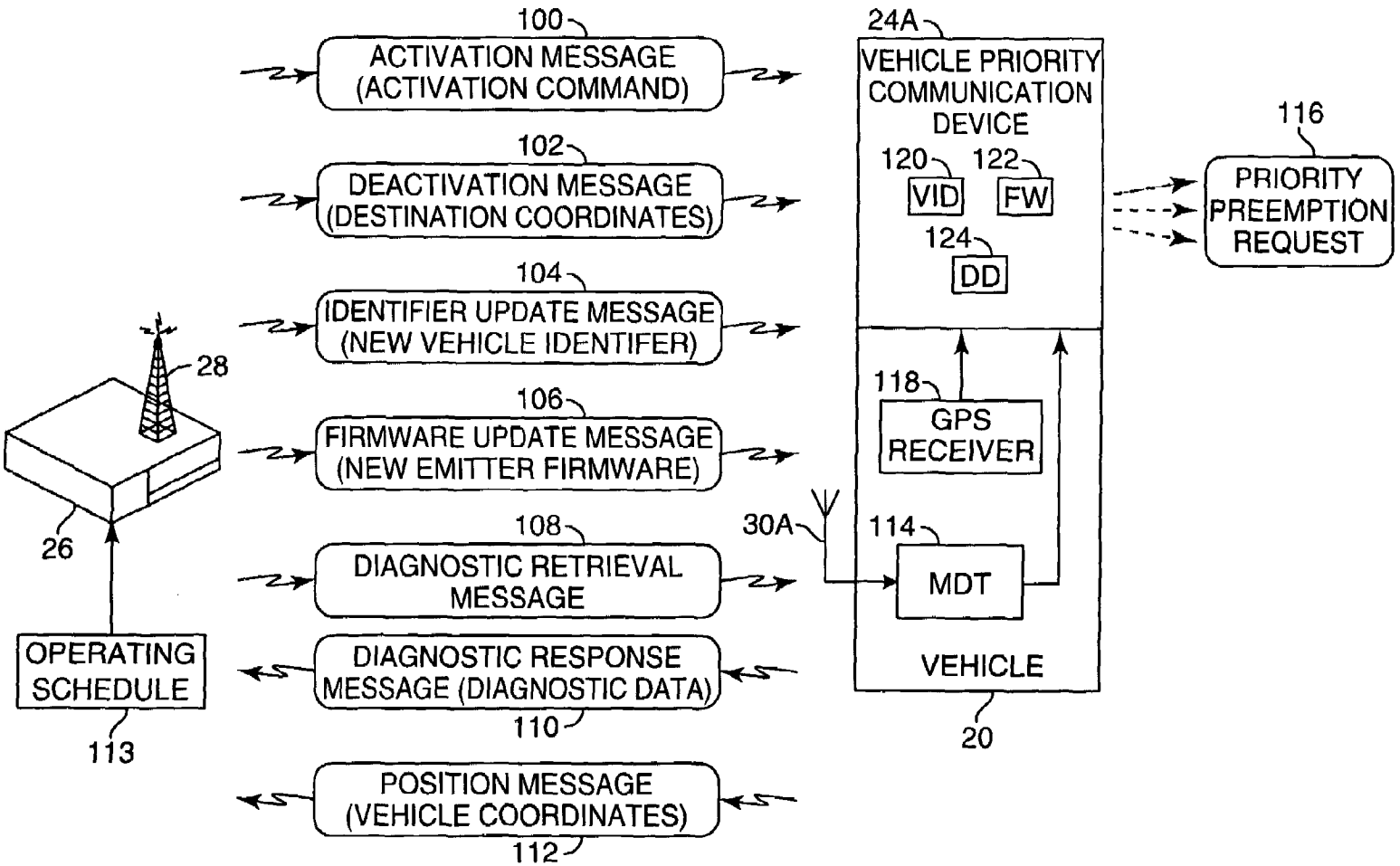
FIG. 2 is a block diagram of certain components of an example of the vehicle priority system shown in FIG. 1.

FIG. 2 is a block diagram of certain components of an example of the vehicle priority system shown in FIG. 1. In FIG. 2, a control center, such as dispatch center 26, transmits messages 100 through 108 via antenna 28 and receives message 110 and 112 via antenna 28. An vehicle-priority communication device 24A, which may include an optical emitter, mounted to vehicle 20 receives messages 100 through 108 and transmits messages 110 and 112 via antenna 30A and mobile data terminal 114.

In response to receiving activation message 100 from dispatch center 26, the vehicle-priority communication device 24A starts transmitting a stream of light pulses or a radio frequency signal representing a priority preemption request 116. The normal operation of traffic signals (not shown) is preempted in response to the priority preemption request 116 to permit expedited passage of the vehicle 20 through the traffic signals. In one embodiment, the activation message 100 is transmitted by the dispatch center 26 when a mass transit vehicle (not shown) is determined to be lagging behind an operating schedule 113 for the mass transit vehicle, as previously discussed. The operating schedule 113 can be a published operating schedule for the mass transit vehicle.

In one embodiment, mobile data terminal 114 is mounted in the cab of an emergency vehicle, such as a police car, and mobile data terminal 114 is connected via a radio channel to the dispatch center 26. When a police officer is dispatched to an incident, the mobile data terminal 114 can be used to relay textual and graphical information, including the incident destination, travel route, type of incident, chemical hazards, and the position of other assets that are responding to the incident. A portion of the information relayed to the mobile data terminal 114, such as the type of incident, can constitute the activation message 100 that starts the transmission of the priority preemption request 116 from the vehicle-priority communication device 24A. In addition, a portion of the information relayed to the mobile data terminal 114, such as the incident destination, can constitute a deactivation message 102. In one embodiment, the destination coordinates from a deactivation message 102 are compared with current coordinates of the vehicle 20 from the GPS receiver 118 and the vehicle-priority communication device 24A terminates the transmission of the stream of light pulses or radio frequency signal representing the priority preemption request 116 in response to the vehicle 20 approaching the destination.

In another embodiment, one or both of the activation message 100 and the deactivation message 102 are commands that are not interpreted by the vehicle-priority communication device 24A using additional information, such as the current position of the vehicle 20 from the GPS receiver 118. An activation message 100 that is an activation command allows dispatch center 26 to directly compel the vehicle-priority communication device 24A to begin transmitting a stream of light pulses or radio frequency signal representing the priority preemption request 116. Similarly, a deactivation message 102 that is a deactivation command allows dispatch center 26 to directly compel the vehicle-priority communication device 24A to cease transmitting the stream of light pulses or radio frequency signal representing the priority preemption request 116.

Vehicle-priority communication device 24A can have an associated vehicle identifier 120 and priority preemption request 116 may include the vehicle identifier 120 for purposes such as maintaining security of the vehicle priority system. Updating of the vehicle identifier 120 may be necessary during set-up and ongoing maintenance of the vehicle-priority communication device 24A and the vehicle priority system that includes the vehicle-priority communication device 24A. Dispatch center 26 can transmit an identifier update message 104 to the vehicle-priority communication device 24A to update the vehicle identifier 120. Identifier update message 104 may include the new vehicle identifier and other identifying information such as the existing value of the vehicle identifier 120 and/or an assigned serial number for the vehicle-priority communication device 24A.

Vehicle-priority communication device 24A may have one or more internal microprocessors controlling the operation of the vehicle-priority communication device 24A. These internal microprocessors can have associated firmware 122. New features can be added to the functionality of the vehicle-priority communication device 24A and defects in the vehicle-priority communication device 24A can be fixed by updating the firmware 122. Dispatch center 26 can transmit a firmware update message 106 including the new firmware to replace the existing firmware 122.

Vehicle-priority communication device 24A may include diagnostic data 124, such as logs of the operation of the vehicle-priority communication device 24A, including detected error conditions. Dispatch center 26 may read the contents of the diagnostic data 124 by transmitting a diagnostic retrieval message 108. The vehicle-priority communication device 24A may respond to the diagnostic retrieval message 108 with a diagnostic response message 110 that includes the current contents of the diagnostic data 124. In another embodiment, the vehicle-priority communication device 24A can spontaneously transmit a diagnostic response message 110 for certain operation conditions of the vehicle-priority communication device 24A, such as error conditions impacting the safe operation of the vehicle 20 and/or the vehicle priority system.

Vehicle-priority communication device 24A may periodically transmit a position message 112 including coordinates of the current position of the vehicle 20 from the GPS receiver 118. The transmission of the position message 112 can be eliminated or the frequency of periodically transmitting the position message 112 can reduced when the GPS receiver 118 indicates that the vehicle 20 is stationary. In another embodiment, the dispatch center 26 can transmit a position retrieval message (not shown) that causes the vehicle-priority communication device 24A to transmit a position message 112 including the current position of the vehicle 20.

Figure 3:
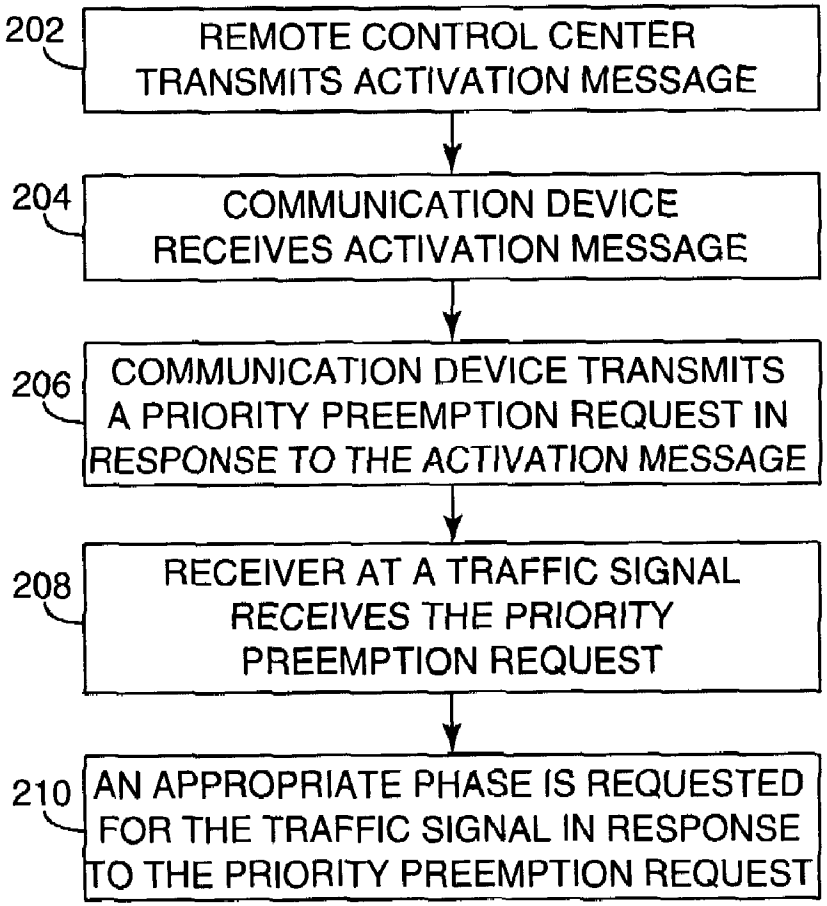
FIG. 3 is a flow diagram of the operation of the vehicle priority system at a vehicle and an intersection in accordance with the present invention.

FIG. 3 is a flow diagram of the operation of the vehicle priority system at a vehicle and an intersection in accordance with the present invention. At step 202, a remotely situated control center transmits an activation message. The activation message is received at an vehicle-priority communication device mounted to a vehicle at step 204. In one embodiment, the activation message is an activation command. At step 206, the vehicle-priority communication device transmits light pulses or a radio frequency signal that encode a priority preemption request in response to the activation message. At step 208, a receiver situated at a traffic signal receives the light pulses or radio frequency signal that encodes the priority preemption request. At step 210 an appropriate phase, which can be dependent on which one of multiple receivers received the priority preemption request at step 208, is requested for the traffic signal in response to the priority preemption request received at step 208.

The phase request for the traffic signal can adjust or maintain the phase of the traffic signal to allow expedited passage of the vehicle through the traffic signal by presenting a green light to the vehicle. In another embodiment, the control center can also transmit a deactivation message that terminates transmission of the priority preemption request from the vehicle-priority communication device. In yet another embodiment, starting the transmission of the priority preemption request at step 206 and/or terminating the transmission of the priority preemption request in response to a deactivation message can be dependent on the position of the vehicle provided by a GPS receiver associated with the vehicle.

While certain aspects of the present invention have been described with reference to several particular example embodiments, those skilled in the art will recognize that many changes may be made thereto. For example, the vehicle-priority communication device can be implemented using a signal processing circuit arrangement including one or more processors, volatile and/or nonvolatile memory, and a combination of one or more analogy, digital, discrete, programmable-logic, semi-programmable logic, non-programmable logic circuits. Examples of such circuits for comparable signal processing tasks are described in the previously-discussed commercial devices and various references including, for example, U.S. Pat. No. 5,172,113, U.S. Pat. No. 5,519,389, U.S. Pat. No. 5,539,398 and U.S. Pat. No. 4,162,447. Such implementations and adaptations are embraced by the above-discussed embodiments without departing from the spirit and scope of the present invention, aspects of which are set forth in the following claims.

What is claimed is:

1. A remotely-activated vehicle priority system, comprising:

a control center comprising a dispatch center adapted to transmit an activation message;

a vehicle-priority communication device mounted to a vehicle and communicatively coupled to the control center, the vehicle-priority communication device adapted to transmit a priority preemption request in response to the activation message;

a mobile data terminal associated with the vehicle, wherein the activation message is a portion of data transmitted from the control center to the mobile data terminal;

at least one receiver situated at a traffic signal and adapted to receive the priority preemption request; and a phase selector coupled to the at least one receiver and adapted to issue, responsive to the priority preemption request, a command to a controller of the traffic signal, wherein the command selects a phase for the traffic signal.

2. The remotely-activated vehicle priority system of claim 1, wherein the priority preemption request includes an identifier of the vehicle.

3. The remotely-activated vehicle priority system of claim 2, wherein the control center is further adapted to transmit an identifier update message and the vehicle-priority communication device is further adapted to update the identifier of the vehicle in response to the identifier update message.

4. A remotely-activated vehicle priority system, comprising:

a control center comprising a dispatch center adapted to transmit an activation and deactivation message;

a vehicle-priority communication device mounted to a vehicle and communicatively coupled to the control center, the vehicle-priority communication device adapted to transmit a priority preemption request in response to the activation message and terminate the transmission of the priority preemption request in response to the deactivation message;

at least one receiver situated at a traffic signal and adapted to receive the priority preemption request; and a phase selector coupled to the at least one receiver and adapted to issue, responsive to the priority preemption request, a command to a controller of the traffic signal, wherein the command selects a phase for the traffic signal.

5. The remotely-activated vehicle priority system of claim 4, wherein the deactivation message includes coordinates of a destination for the vehicle and the vehicle-priority communication device is further adapted to terminate the transmission of the priority preemption request in response to the vehicle approaching the destination.

6. The remotely-activated vehicle priority system of claim 5, further comprising a global positioning satellite (GPS) receiver associated with the vehicle, wherein the vehicle-priority communication device is further adapted to determine that the vehicle is approaching the destination from the coordinates of the destination and coordinates from the GPS receiver.

7. A remotely-activated vehicle priority system, comprising:

a control center comprising a dispatch center adapted to transmit an activation message;

a vehicle-priority communication device mounted to a vehicle and communicatively coupled to the control center, the vehicle-priority communication device adapted to transmit a priority preemption request in response to the activation message;

a global positioning satellite (GPS) receiver associated with the vehicle, wherein the vehicle-priority communication device is further adapted to transmit coordinates of the vehicle from the GPS receiver to the control center;

at least one receiver situated at a traffic signal and adapted to receive the priority preemption request; and a phase selector coupled to the at least one receiver and adapted to issue, responsive to the priority preemption request, a command to a controller of the traffic signal, wherein the command selects a phase for the traffic signal.

8. The remotely-activated vehicle priority system of claim 7, wherein the control center is further adapted to transmit the activation message in response to the coordinates of the vehicle.

9. The remotely-activated vehicle priority system of claim 8, wherein the vehicle is a mass transit vehicle having an operating schedule and the control center is further adapted to transmit the activation message in response to the mass transit vehicle lagging behind the operating schedule.

10. The remotely-activated vehicle priority system of claim 7, wherein the control center is further adapted to transmit a deactivation message in response to the coordinates of the vehicle and the vehicle-priority communication device is further adapted to terminate the transmission of the priority preemption request in response to the deactivation message.

11. The remotely-activated vehicle priority system of claim 10, wherein the vehicle is a mass transit vehicle having an operating schedule and the control center is further adapted to transmit the deactivation message in response to the mass transit vehicle not lagging behind the operating schedule.

12. A remotely-activated vehicle priority system, comprising:

a control center comprising a dispatch center adapted to transmit an activation message and a firmware update message;

a vehicle-priority communication device mounted to a vehicle and communicatively coupled to the control center, the vehicle-priority communication device adapted to transmit a priority preemption request in response to the activation message and to update firmware controlling the operation of the vehicle-priority communication device in response to the firmware update message;

at least one receiver situated at a traffic signal and adapted to receive the priority preemption request; and a phase selector coupled to the at least one receiver and adapted to issue, responsive to the priority preemption request, a command to a controller of the traffic signal, wherein the command selects a phase for the traffic signal.

13. A remotely-activated vehicle priority system, comprising:

a control center comprising a dispatch center adapted to transmit an activation message and a diagnostic retrieval message;

a vehicle-priority communication device mounted to a vehicle and communicatively coupled to the control center, the vehicle-priority communication device adapted to transmit a priority preemption request in response to the activation message and diagnostic data to the control center in response to the diagnostic retrieval message;

at least one receiver situated at a traffic signal and adapted to receive the priority preemption request; and a phase selector coupled to the at least one receiver and adapted to issue, responsive to the priority preemption request, a command to a controller of the traffic signal, wherein the command selects a phase for the traffic signal.

14. A method for remotely activating a vehicle priority system, comprising:

transmitting an activation message from a remote dispatch control center;

receiving the activation message at a vehicle-priority communication device mounted to a vehicle;

transmitting a priority preemption request from the vehicle-priority communication device in response to the activation message;

receiving the priority preemption request at a receiver situated proximate to a traffic signal;

requesting a phase for the traffic signal in response to the priority preemption request;

transmitting a deactivation message from the remote dispatch control center;

receiving the deactivation message at the vehicle-priority communication device; and terminating the transmission of the priority preemption request from the vehicle-priority communication device in response to the deactivation message.

15. The method of claim 14, further comprising determining a position of the vehicle using a global positioning satellite (GPS) receiver, wherein the deactivation message is transmitted in response to the position of the vehicle.

16. The method of claim 14, further comprising determining a position of the vehicle using a global positioning satellite (GPS) receiver, wherein the activation message is transmitted in response to the position of the vehicle.

* * * * *